US007841914B1

(12) United States Patent
Gonzalez

(10) Patent No.: US 7,841,914 B1
(45) Date of Patent: Nov. 30, 2010

(54) FLOATING APPARATUS WITH MANUAL DRIVER

(76) Inventor: Josue Gonzalez, 104 Conforti Ave., West Orange, NJ (US) 07052

( * ) Notice: Subject to any disclaimer, the term of this patent is extended or adjusted under 35 U.S.C. 154(b) by 92 days.

(21) Appl. No.: 12/277,710

(22) Filed: Nov. 25, 2008

(51) Int. Cl.
*B63H 16/20* (2006.01)

(52) U.S. Cl. ..... 440/26; 440/31

(58) Field of Classification Search ..... 440/26, 440/31

See application file for complete search history.

(56) References Cited

U.S. PATENT DOCUMENTS

| | | | | |
|---|---|---|---|---|
| 2,139,022 | A | 8/1936 | Johnson | |
| 3,180,306 | A * | 4/1965 | Gouedy | 440/26 |
| 3,272,173 | A | 9/1966 | Avellino | |
| 4,092,945 | A | 6/1978 | Ankert et al. | |
| 4,115,888 | A | 9/1978 | Sievers | |
| 5,030,145 | A | 7/1991 | Chase | |
| 5,194,024 | A | 3/1993 | Shiraki | |
| 5,403,220 | A | 4/1995 | Goad, Sr. | |
| 5,743,772 | A * | 4/1998 | Assawah et al. | 440/28 |
| 5,830,020 | A * | 11/1998 | Snyder | 440/12 |
| 5,921,824 | A | 7/1999 | Hagan | |
| 6,000,353 | A | 12/1999 | De Leu | |
| 6,033,276 | A * | 3/2000 | Han | 441/135 |
| 6,036,555 | A | 3/2000 | Takacs | |
| 6,558,210 | B2 | 5/2003 | Frasier | |
| 6,746,293 | B1 | 6/2004 | Kirby, Jr. et al. | |
| 6,773,319 | B1 | 8/2004 | Carlini, Jr. | |
| 7,025,418 | B1 | 4/2006 | Hackal | |

OTHER PUBLICATIONS

User's Guide for Motorized Pool Lounger, Excalibur Electronics, Inc., Model No. PR10, 13755 SW 119th Avenue, Miami, Florida 33186 U.S.A.

* cited by examiner

*Primary Examiner*—Stephen Avila
(74) *Attorney, Agent, or Firm*—Thomas L. Adams

(57) ABSTRACT

A floating apparatus is arranged to be propelled manually. The apparatus has a float with a head and a foot for supporting a recumbent person. Also included is a hull attached under the float. The hull has a first end and a second end and is narrower than the float. The apparatus has a propeller shaft with a propeller that is rotatably mounted in the hull. Also included is a manual driver for rotating the propeller shaft. The manual driver is mounted at the first end of the hull and the propeller is mounted at the second end of the hull.

16 Claims, 2 Drawing Sheets

FLOATING APPARATUS WITH MANUAL DRIVER

BACKGROUND OF THE INVENTION

1. Field of the Invention

The present invention relates to floating apparatus for supporting a recumbent person, and in particular, to apparatus that can be propelled by human exertion.

2. Description of Related Art

Many recreational activities center around a pool or other body of water. However, people enjoy the water in various ways. Some may enjoy swimming vigorously while others may just wish to float leisurely. Some will simply enjoy lying on a small raft floating in a pool or on some other body of water. The raft can be inflatable or made of a lightweight foam that floats.

Often the person on a raft will want to move to some favorable position and remain there. This can be done by paddling by hand to the new position, followed by more leisurely paddle strokes to remain in place. Navigating a raft in this manner can be bothersome, especially if one hand is holding a drink or other object. Also, dead reckoning towards a fixed destination can be difficult when forward visibility is impaired because a person is lying supine on a raft.

Some watercraft can be steered by a rudder whose angle is adjusted by a tiller or a wheel. Still other watercraft, such as a canoe, will be rudderless and the right to left balance of the paddling will steer the canoe.

Known watercraft can be propelled by a motor-driven propeller. The propeller may be located to the stern of a watertight hull. Other watercraft can be powered by a sail and some sailboats will have hand cranks operating winches to raise and adjust various sails.

See also U.S. Pat. Nos. 2,139,022; 3,272,173; 4,092,945; 4,115,888; 5,030,145; 5,194,024; 5,403,220; 5,743,772; 5,921,824; 6,000,353; 6,033,276; 6,036,555; 6,558,210; 6,746,293; 6,773,319; and 7,025,418.

SUMMARY OF THE INVENTION

In accordance with the illustrative embodiments demonstrating features and advantages of the present invention, there is provided a floating apparatus arranged to be propelled manually. The apparatus has a float with a head and a foot for supporting a recumbent person. Also included is a hull attached under the float. The hull has a first end and a second end and is narrower than the float. The apparatus has a propeller shaft with a propeller rotatably mounted in the hull. Also included is a manual driver for rotating the propeller shaft. The manual driver is mounted at the first end of the hull and the propeller is mounted at the second end of the hull.

In accordance with another aspect of the invention there is provided a floating apparatus arranged to be propelled manually. The apparatus has a float including a foam panel with a head and a foot for supporting a recumbent person. Also included is a V-shaped hull with a plurality of side vents attached under the float. The hull has a first end that is closed and a second end that is open and has two tail fins. The hull is narrower than the float and has gunwales comprising a right and a left flange. The gunwales are upwardly curved at the first end. The float has an upwardly sloped section overlaying the upwardly curved gunwales. The apparatus also has a rudder pivotally mounted in front of the hull at the first end. The rudder has a tiller projecting through the float. Also included is a propeller shaft with a propeller. The propeller shaft is rotatably attached to and supported by the float inside the hull. The float overhangs the propeller, which is located at the second end of the hull. The apparatus also has a manual driver mounted at the first end of the hull for rotating the propeller shaft. The manual driver includes a crankshaft mounted athwart the hull. The propeller shaft has a gear. The crankshaft has a worm engaging the gear on the propeller shaft.

By employing apparatus and techniques of the foregoing type an improved personal floating apparatus is achieved. A disclosed float is propelled with a hand crank and steered with a rudder. A basic embodiment employs a foam panel with a relatively narrow, V-shaped hull mounted underneath the float.

The gunwales of the disclosed hull curve up at the bow. The head of the foam panel conforms to the upward curve at the bow and also serves as a head rest. This panel also extends further and hangs over the end of the bow.

Inside the hull a long propeller shaft is held in place by pillow block bearings supported on the underside of the float. A hand powered crankshaft mounted athwart under the float and near the bow drives the propeller shaft and its propeller through a worm gear to move the float.

In one embodiment the stern of the hull is open and the propeller is mounted inboard so as to be covered overhead by the float panel. Side vents in the hull enable water to flow into the hull allowing the propeller to work underwater.

A rudder is attached to the leading edge of the bow in order to steer the floating apparatus. The bow rudder is attached to a hand crank that protrudes upwardly through a hole in the foam panel to provide a manually operable tiller. A person reaches above their head to turn the tiller and steer the floating apparatus.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
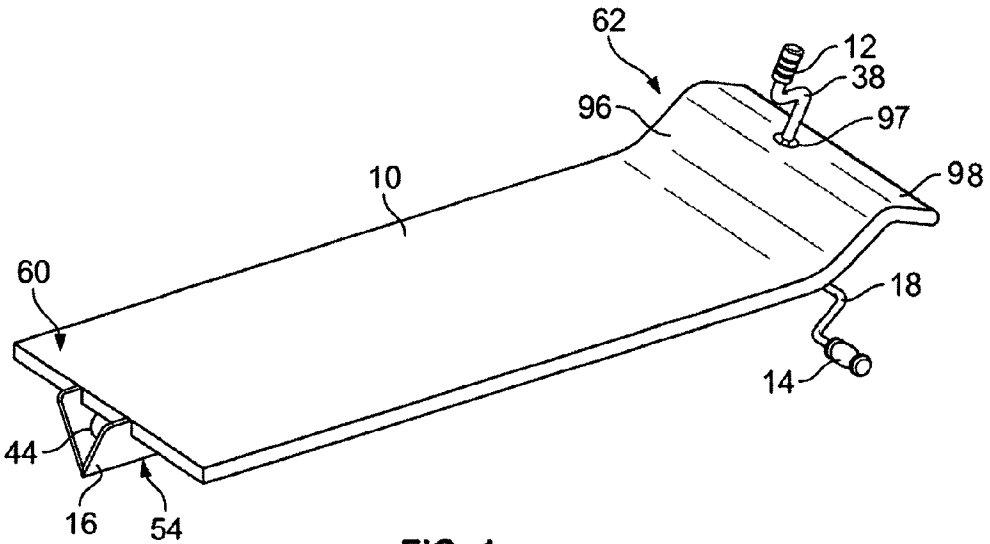
FIG. 1 is a perspective view of a floating apparatus in accordance with principles of the present invention.
Figure 2:
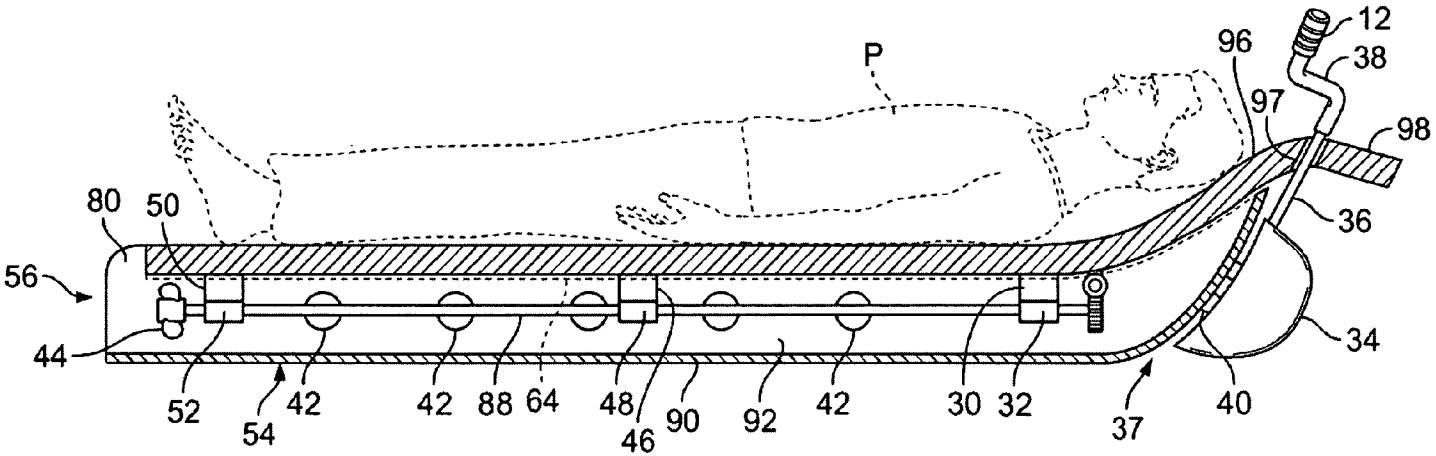
FIG. 2 is a longitudinal sectional view of the apparatus of FIG. 1.
Figure 3:
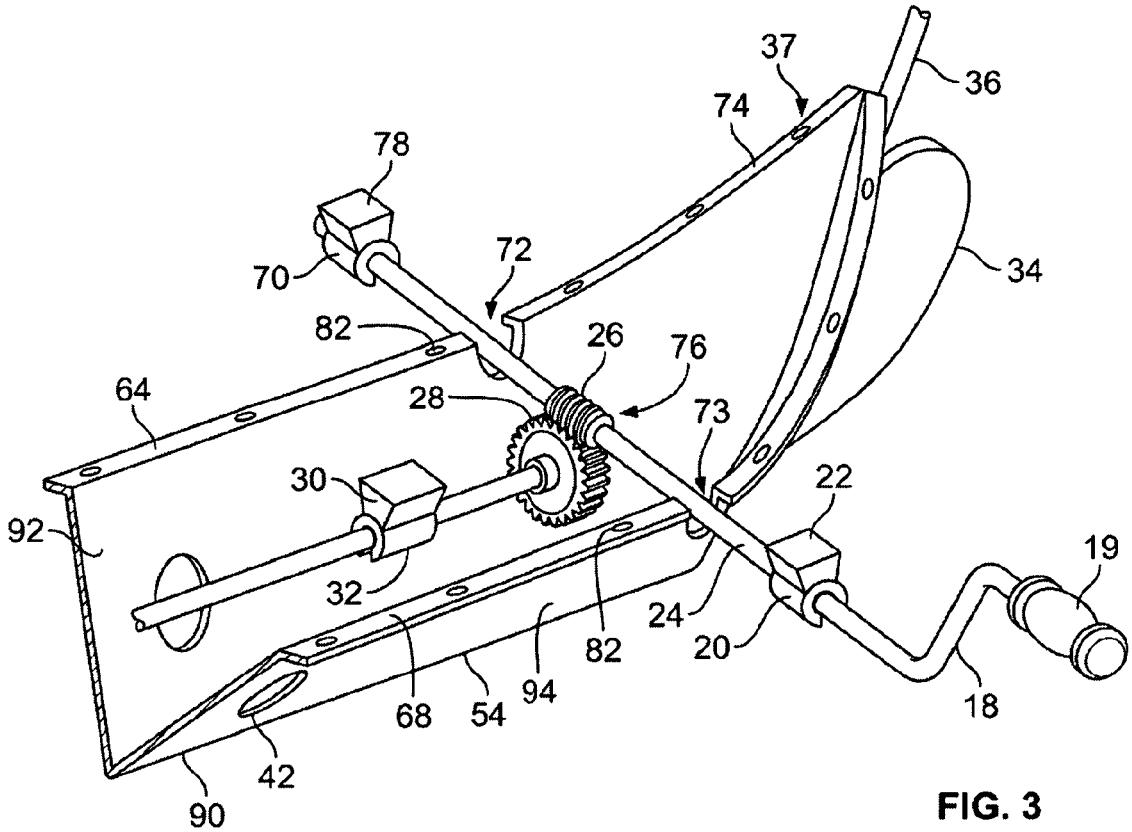
FIG. 3 is a perspective fragmentary view showing the first end or bow of the hull with the float removed to show an internal drive mechanism.
Figure 4:
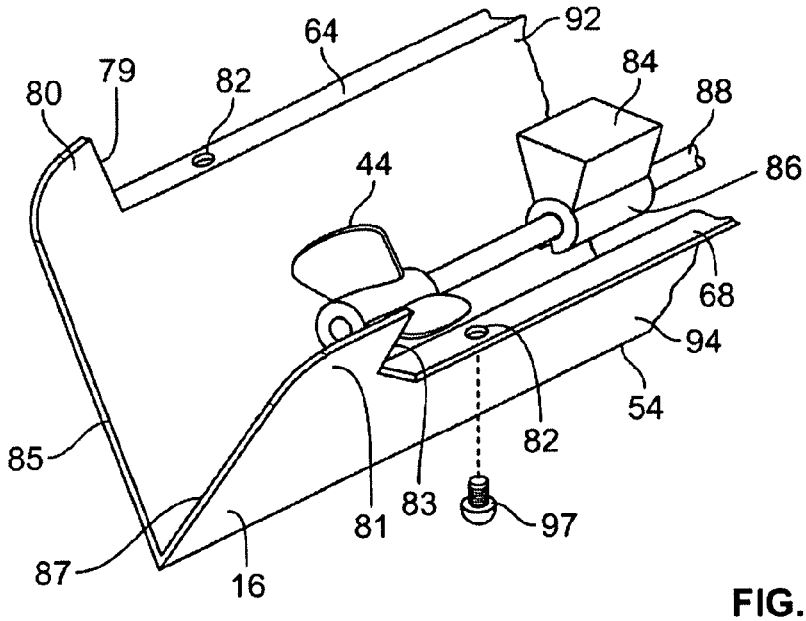
FIG. 4 is a perspective view showing the second end or stern of the hull with the float removed and showing the aft end of the internal mechanism of FIG. 3.

Referring to FIGS. 1-4, the illustrated floating apparatus comprises V-shaped hull 54 (FIG. 2), fabricated of sheet metal or plastic, mounted underneath float 10. Hull 54 has a first end 37 or bow that is closed and a second end 56 or stern that is open.

A cross section transverse to keel 90 around the middle part of the hull 54 would show a left side 92 and a right side 94 converging at approximately 60°. Each of the sides 92, 94 has five, equidistantly spaced circular side vents 42. The top edges of the sides 92 and 94 have a left flange 64 and a right flange 68; these flanges also being referred to as gunwales.

The flanges 64 and 68 are horizontal and parallel to keel 90 from the second end 56 up until bow 37.

At bow 37 the left and right sides 92 and 94 of the hull 54 curve inward to create a canoe-like end. Along bow 37 flanges 64 and 68 (together with sides 92 and 94) ascend in an upward curve and converge together. A plurality of rivet holes 82 are formed along the flanges 64 and 68 from the stern 56 and through bow 37. Notches 72, 73 are located at the transition from the hull's mid-section to bow 37 and pierce flanges 64, 68 and the tops of the sides 92, 94.

The stern 56 is open and left tail fin 80 and right tail fin 81 extend upwardly from and coplanar with sides 92, 94, aft of flanges 64, 68. Tail fins 80 and 81 have leading edges 79 and 83 transverse to keel 90. Fins 80 and 81 also have top edges that curve down to meet transverse trailing edges 85, 87 at the end of the hull 54. Tail fins 80, 81 converge at 60°.

Float 10 is made from a rectangular foam panel and has a head 62 and foot 60. The foam panel 10 is essentially flat but has a section 96 that slopes upwardly at an obtuse angle, and leads to a downwardly sloped, cantilevered section 98. A central hole 97 at the proximal end of cantilevered section 98 extends through float 10.

Flanges 64 and 68 of hull 54 are attached to the underside of float 10 by rivets 97 inserted through rivet holes 82. Rivets 97 are glued into matching blind holes (not shown) on the underside of the float 10 from foot 60 through upwardly sloped section 96.

Crescent shaped rudder 34 is pivotally mounted at the front edge of bow 37 with hinge 40, which has knuckles similar to an ordinary door hinge. The inside, concave edge of the rudder 34 matches the convex, front edge of bow 37.

A crankshaft 36, attached to the upper corner of rudder 34, protrudes through hole 97 in cantilevered section 98 of float 10. Shaft 36 terminates in a crank 38, which acts as a tiller. A rubber or plastic sleeve covers crank 38, which cover is thickened at its distal end into a ribbed tiller handle 12.

A propeller shaft 88 within hull 54 is positioned above and parallel to keel 90 and below float 10. Propeller shaft 88 is a plastic tube and is rotatably supported by three pillow block bearings 30, 46, 50 glued along the centerline of the underside of float 10. Block bearings 30, 46, 50 support the propeller shaft 88 at three places: a forward position, a stern position and middle position. Block bearing 30, 46, 50 have a pyramidical base supporting split cylinders 32, 48, 52. Shaft 88 is installed by spreading cylinders 32, 48, 52 and snapping the shaft into place. Pillow block bearings 30, 46, 50 are plastic and split cylinders 32, 48, 52 are lined with Teflon® material to reduce friction.

Propeller 44 is pinned onto the stern end of shaft 88 inboard of tail fins 80, 81 with float 10 overhanging. Gear 28 is attached to the forward end of propeller shaft 88 in a plane aligning with notches 72, 73. Worm 26 has spiral teeth that intermesh with the teeth of gear 28. Worm 26 is mounted at the center of shaft 76, which passes through notches 72, 73.

Pillow block bearings 78, 22 are glued to underside of float 10 to the outside of hull 54 in alignment with notches 72 and 73. Block bearings 78 and 22 support crankshaft 24 near its left and right end. The right end of shaft 24 has a crank 18 and a tubular handle 14 is mounted on handle portion of crank 18. Gear 28, worm 26, shaft 24, crank 18 and pillow block bearings 78, 22 are referred to herein as manual driver 76.

To facilitate an understanding of the principles associated with the foregoing apparatus, it's operation will be briefly described. To begin, the floating apparatus is placed in water at least two feet deep. A recumbent person P lays on their back or stomach on float 10 with their head resting against the sloped section 96 at the bow 37. Person P can move forward by reaching with over the right flange 68 and grasping the handle 19 on the crank 18 and turning it clockwise. The crank 18 turns the worm 26 to drive the teeth on gear 28. This turns shaft 88 and propeller 44 at the stern 56. Propeller 44 expels from stern 56 water which is replaced by water entering hull 54 by side vents 42.

By its physical nature, hull 54 stiffens and stabilizes float 10. Also, the propeller 44 is nestled within hull 54 at the stern 56 and is thereby shielded from the dangling feet of the recumbent person as well as limbs or long hair of a nearby swimmer.

If float 10 is not headed in a desired direction, a person can adjust the tiller 12. By reaching overhead and grabbing the tiller handle 12 and turning it, the crank 38 will turn the crankshaft 36 and turn rudder 34 accordingly. Float 10 will turn left by turning the handle 12 towards the right side of the hull 94. By turning the handle this way rudder 34 will swing left steering bow 58 to the left also. The float 10 will turn right by turning the handle 12 towards the left side of the hull 92. By turning the handle this way the rudder will swing right steering bow 58 to the right also.

If the floating apparatus bumps up against something the rudder 34 will pivot towards the bow 58 if the handle 12 is not being held firm. By holding the handle 12 steady the rudder cushions the float 10 from impact. A person can propel the float 10 backwards by turning crank 18 counterclockwise.

It is appreciated that various modifications may be implemented with respect to the above described embodiments. For example the worm can be replaced with a pair of bevel gears with a gear ratio the makes the propeller spin faster or slower than the hand crank. Furthermore, the propeller can be located further forward in some cases. In some embodiments the hull can be wider or narrower than shown and can be made flexible to flex with the float, in which case a flexible propeller shaft may be chosen. Also, instead of a V-shaped profile, the hull can have a rounded keel and amidship, sides that are concave or convex. In fact the hull can be reduced to provide just enough clearance to hold the propeller shaft and its bearings. In addition, the hull may be an integral feature of the float that is created when the float is molded. Furthermore, the float may be larger in order to support more than one person. In some embodiments the float will have side pontoons to increase its stability and weight bearing capacity. Also, the rudder may have a detent or friction feature to hold the rudder steady without hand pressure.

Obviously, many modifications and variations of the present invention are possible in light of the above teachings. It is therefore to be understood that within the scope of the appended claims, the invention may be practiced otherwise than as specifically described.

The invention claimed is:

1. A floating apparatus arranged to be propelled manually, comprising:

a float having a head and a foot for supporting a recumbent person, said float comprising a foam panel;

a hull attached under said float and having a first end and a second end, said hull being narrower than said float, said hull at the first end having upwardly curved gunwales, said float having an upwardly sloped section overlaying said upwardly curved gunwales;

a propeller shaft including a propeller rotatably mounted in said hull; and a manual driver for rotating said propeller shaft, said manual driver being mounted at the first end of said hull, said propeller being mounted at the second end of said hull.

2. A floating apparatus according to claim 1 wherein said float overhangs said propeller.

3. A floating apparatus according to claim 1 wherein said propeller shaft is rotatably attached to and supported by said float.

4. A floating apparatus according to claim 1 wherein said hull has a pivotally mounted rudder.

5. A floating apparatus according to claim 4 wherein said rudder is mounted in front of said hull at the first end.

6. A floating apparatus according to claim 5 wherein said rudder has a tiller projecting through said float.

7. A floating apparatus according to claim 4 wherein said float comprises a foam panel.

8. A floating apparatus according to claim 1 wherein said manual driver comprises:

a crankshaft mounted athwart said hull.

9. A floating apparatus according to claim 8 wherein said propeller shaft has a gear, said crankshaft having a worm engaging said gear on said propeller shaft.

10. A floating apparatus according to claim 8 wherein said crankshaft is rotatably attached to and supported by said float.

11. A floating apparatus arranged to be propelled manually, comprising:

a float having a head and a foot for supporting a recumbent person;

a hull attached under said float and having a first end and a second end, said hull being narrower than said float, said hull being closed at the first end and open at the second end;

a propeller shaft including a propeller rotatably mounted in said hull; and a manual driver for rotating said propeller shaft, said manual driver being mounted at the first end of said hull, said propeller being mounted at the second end of said hull.

12. A floating apparatus according to claim 11 wherein said hull is V-shaped.

13. A floating apparatus according to claim 11 wherein said hull has a plurality of side vents.

14. A floating apparatus according to claim 11 wherein said hull has gunwales comprising a right and a left flange.

15. A floating apparatus according to claim 11 wherein said hull has at the second end a pair of tail fins.

16. A floating apparatus arranged to be propelled manually, comprising:

a float including a foam panel having a head and a foot for supporting a recumbent person;

a V-shaped hull with a plurality of side vents attached under said float, said hull having a first end that is closed and a second end that is open and has two tail fins, said hull being narrower than said float, said hull having gunwales comprising a right and a left flange, said gunwales being upwardly curved at the first end, said float having an upwardly sloped section overlaying said upwardly curved gunwales;

a rudder pivotally mounted in front of said hull at the first end, said rudder having a tiller projecting through said float;

a propeller shaft including a propeller, said propeller shaft being rotatably attached to and supported by said float inside said hull, said float overhanging said propeller, said propeller being located at the second end of said hull; and a manual driver mounted at the first end of said hull for rotating said propeller shaft, said manual driver comprising a crankshaft mounted athwart said hull, said propeller shaft having a gear, said crankshaft having a worm engaging said gear on said propeller shaft.

* * * * *